US005544432A

United States Patent [19]

Kita

[11] Patent Number: 5,544,432

[45] Date of Patent: Aug. 13, 1996

[54] INSOLE FOR SHOES PROVIDING HEEL STABILIZATION

[75] Inventor: Kenjiro Kita, Osaka, Japan

[73] Assignee: Mizuno Corporation, Osaka, Japan

[21] Appl. No.: 357,256

[22] Filed: Dec. 13, 1994

[30] Foreign Application Priority Data

Dec. 28, 1993 [JP] Japan ..... 5-075342 U

[51] Int. Cl.[6] ..... A43B 13/38; A43B 19/00

[52] U.S. Cl. ..... 36/43; 36/71

[58] Field of Search ..... 36/28, 43, 44, 36/71, 93

[56] References Cited

U.S. PATENT DOCUMENTS

| | | | |
|---|---|---|---|
| 3,382,511 | 5/1968 | Brooks | 5/355 |
| 4,371,493 | 2/1983 | Minuto | 264/236 |
| 4,534,121 | 8/1985 | Autry | 36/43 X |
| 4,541,186 | 9/1985 | Mulvihill | 36/114 |
| 4,776,109 | 10/1988 | Sacre | 36/43 X |
| 4,808,469 | 2/1989 | Hiles | 36/44 X |
| 4,823,483 | 4/1989 | Chapnick | 36/43 |
| 4,910,886 | 3/1990 | Sullivan et al. | 36/44 |
| 5,068,983 | 12/1991 | Marc | 36/44 |
| 5,146,698 | 9/1992 | Tilles et al. | 36/44 |

FOREIGN PATENT DOCUMENTS

| | | |
|---|---|---|
| 1282517 | 11/1968 | Germany . |
| 50-1855 | 1/1975 | Japan . |
| 59-23528 | 7/1984 | Japan . |
| 59-42892 | 12/1984 | Japan . |
| 61-16807 | 5/1986 | Japan . |
| 62-7126 | 2/1987 | Japan . |
| 62-28163 | 7/1987 | Japan . |
| 4-117903 | 4/1992 | Japan . |
| 4-117974 | 4/1992 | Japan . |
| 890007 | 2/1962 | United Kingdom . |
| 94/17685 | 8/1994 | WIPO . |

OTHER PUBLICATIONS

Abstract of Japanese patent publication 6–220,242, "Cushioning Material", Nov. 11, 1994, vol. 18, No. 591 ( C–1272).

*Primary Examiner*—Jimmy G. Foster
*Assistant Examiner*—BethAnne C. Dayoan
*Attorney, Agent, or Firm*—Keck, Mahin & Cate

[57] ABSTRACT

A cup-like insole includes a body of elastic material having a bottom surface which has a shape to fit to a bottom member of a shoe. The insole has a flat portion and a concave side wall portion formed integrally therewith extending from the area corresponding to the inner arch portion of the foot to the area corresponding to the outer lateral side of the foot through the area corresponding to the heel portion of the foot. An impact cushioning material has bouncing putty and is disposed on the upper surface of the side wall. A sheet made of either woven fabrics, unwoven fabrics, or leather covering over the impact cushioning material secures the material to the body. The cup-like insole, according to the invention, provides improved fitness of the heel portion of a shoe to stabilize the heel of the wearer.

5 Claims, 4 Drawing Sheets

INSOLE FOR SHOES PROVIDING HEEL STABILIZATION

TECHNICAL FIELD

This invention relates to a cup-like insole and more particularly to a cup-like insole having improved fitness of the heel portion of a shoe to stabilize the heel of the wearer.

BACKGROUND OF THE INVENTION

A conventional insole, in general, consists of a body made of materials such as synthetic resin foam or elastomer covered with leather, woven fabrics, unwoven fabrics or the like adhesively bonded thereto. There are some types of such insoles which include one having a flat shape cut out of a sheet material in a shape of the foot, one having a raised portion in the area corresponding to the arch portion of the foot, and one having a raised portion surrounding the heel of the foot so as to fit thereto.

These insoles are employed for the purpose of improving the fitness of the foot, especially the heel of the foot within a shoe by filling the space between the foot and the interior of the shoe, thereby improving the stability of the heel of the foot while walking or running.

The most common type of resin foam utilized for the insoles is the one which can be deformed by compression applied by the heel of the wearer, so as to conform to the shape of the heel, and bounces back to the original shape when the wearer takes off the shoe as described in, for example, Japanese utility model public disclosure Sho 59-42892 and Japan utility model public disclosure Sho 59-23528. There is another type of resin foam which does not bounce back to the original shape once compressively deformed even when the wearer takes off the shoe as described in, for example, Japan utility model public disclosure Sho 61-16807 and Japan utility model public disclosure Sho 62-28163. Furthermore, there is another type, disclosed in Japan utility model public disclosure Sho 62-7126, which is formed by mixing uncured synthetic foam with curing agent, pouring the mixture into a bag-like sheet, and placing the foot of the wearer on the mixture filled bag to press the shape of the foot thereto, whereby an insole which has a close fitness to the foot is formed when the curing process is completed.

Most of these conventional insoles utilize an impact cushioning layer or space filler made of a synthetic foam such as polyurethane, polyolefin, or the like utilizing its physical property of compression-deformation.

Therefore, when a wearer puts on a shoe having such an insole, the impact cushioning layer of the insole made of synthetic foam is deformed due to the weight of the wearer to comform to the shape of the foot of the wearer.

The impact cushioning layer absorbs the impact force applied thereto from the ground during walking and running. However, the impact cushioning layer formed from the synthetic foam is easily deformed by the pressure applied by the heel and can not prevent rolling of the heel.

Therefore, the heel is unstable during walking and running, resulting in rolling of the ankle, which may cause excessive pronation and supination of the foot that can hurt the foot of the-wearer.

In addition, the commonly used materials used to form the impact cushioning layer or the space filler of the insoles such as polyolefin resin foam and chloroprene rubber foam often exhibit so-called permanent set due to the compressive force applied through wearing the shoe repeatedly. That can cause deterioration in its flexibility and the ability to restore the original shape and, therefore, it will no longer function as the impact cushioning layer or the space filler.

SUMMARY OF THE INVENTION

A cup-like insole according to the invention is the type which is of installed within a shoe. It includes a body of elastic material whose bottom surface has a shape to fit to a bottom member of a shoe therein having a flat portion and a concave side wall portion formed integrally therewith extending from the area corresponding to the inner arch portion of the foot to the area corresponding to the outer lateral side of the foot through the area corresponding to the heel portion of the foot. An impact cushioning material has bouncing putty and is disposed on the upper surface of the side wall, and a sheet made of either woven fabrics, unwoven fabrics, or leather covers over the impact cushioning material to secure it to the body.

The impact cushioning material is a pad containing bouncing putty therein which plastically deforms easily when a stress is applied more slowly and exhibits a high degree of bounce under a stress applied suddenly. It may be comprised of a pad including a bag-like sheet member made of polyurethane, silicone rubber, polyvinylchloride or the like with the bouncing putty contained therein and, more preferably, open-cell foam made of, for example, polyurethane impregnated with the bouncing putty. The pad may be formed with stacking parts of sheets impregnated with the bouncing putty, each of which is cut into a flat horseshoe shape and bonded together into a three-dimensional horseshoe shape. Alternatively, the pad may be formed from a unitary block of foam impregnated with the bouncing patty which is cut into the three-dimensional horseshoe shape. It can be formed in either way depending on its usage.

Furthermore, in order to enhance its function as a cup-like insole, the shoe is preferably provided with a cup-like stabilizer or a heel counter made of relatively hard synthetic resin positioned at a bottom member of a shoe in its heel area.

DETAILED DESCRIPTION OF THE PREFERRED EMBODIMENTS

A preferred embodiment of a cup-like insole according to the invention is described with reference to the drawings.

Figure 1:
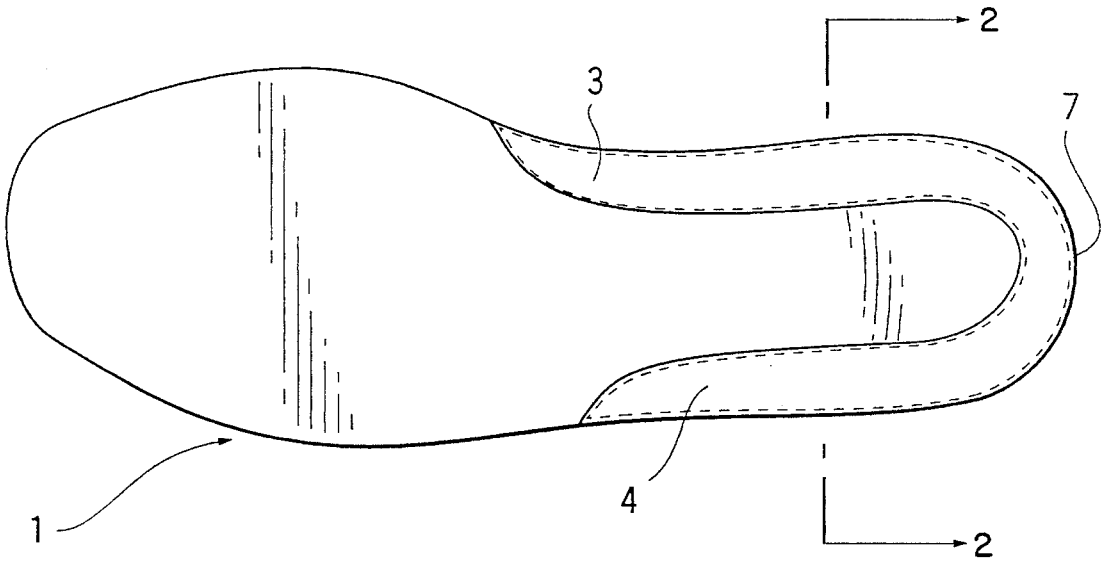
FIG. 1 is a plane view of an embodiment of a cup-like insole according to the invention.
Figure 2:
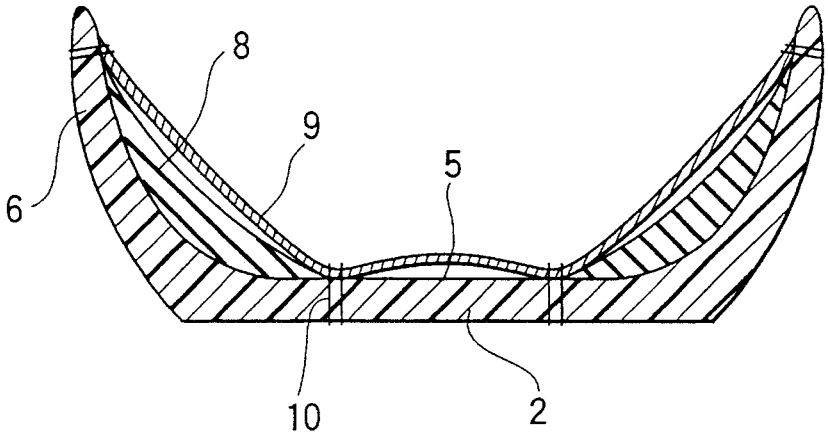
FIG. 2 is a cross-sectional view taken along line A—A of FIG. 1.
Figure 3:
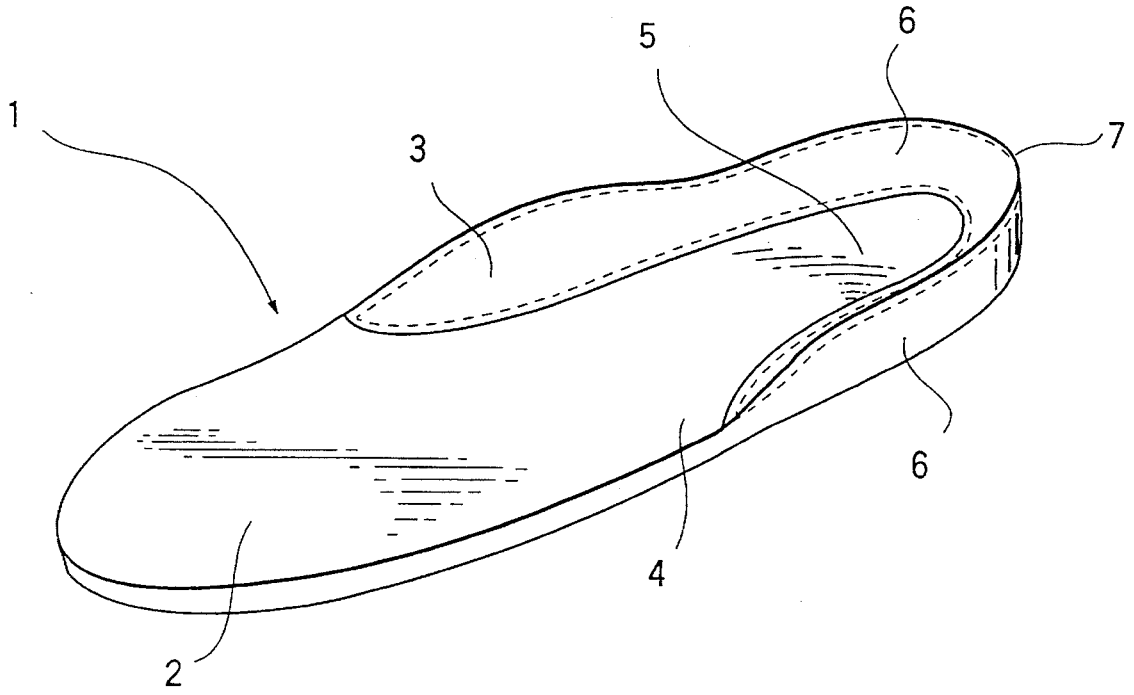
FIG. 3 is a perspective view of a cup-like insole according to the invention.

As can be seen in FIG. 2, a cup-like insole according to the preferred embodiment includes a body 2 of elastic resin having suitable rigidity such as EVA, urethane foam or the like whose bottom surface has a shape to fit to a bottom member of a shoe therein. It has a substantially flat portion 5 and a side wall portion 6 formed integrally therewith extending from the area corresponding to the inner arch portion of the foot 3 to the area corresponding to the outer lateral side of the foot 4 through the area corresponding to the heel portion of the foot 7.

An impact cushioning material 8 formed substantially into a shape of a horse-shoe is disposed on the upper surface of the side wall portion 6 of the body 2. Bouncing putty is utilized for the impact cushioning material 8. Although it is preferrable to use the bouncing putty particles 14 dispersed in open-cell foam 13 as shown in FIG. 6, one having the bouncing putty contained in a bag-like sheet can also be used.

Figure 6:
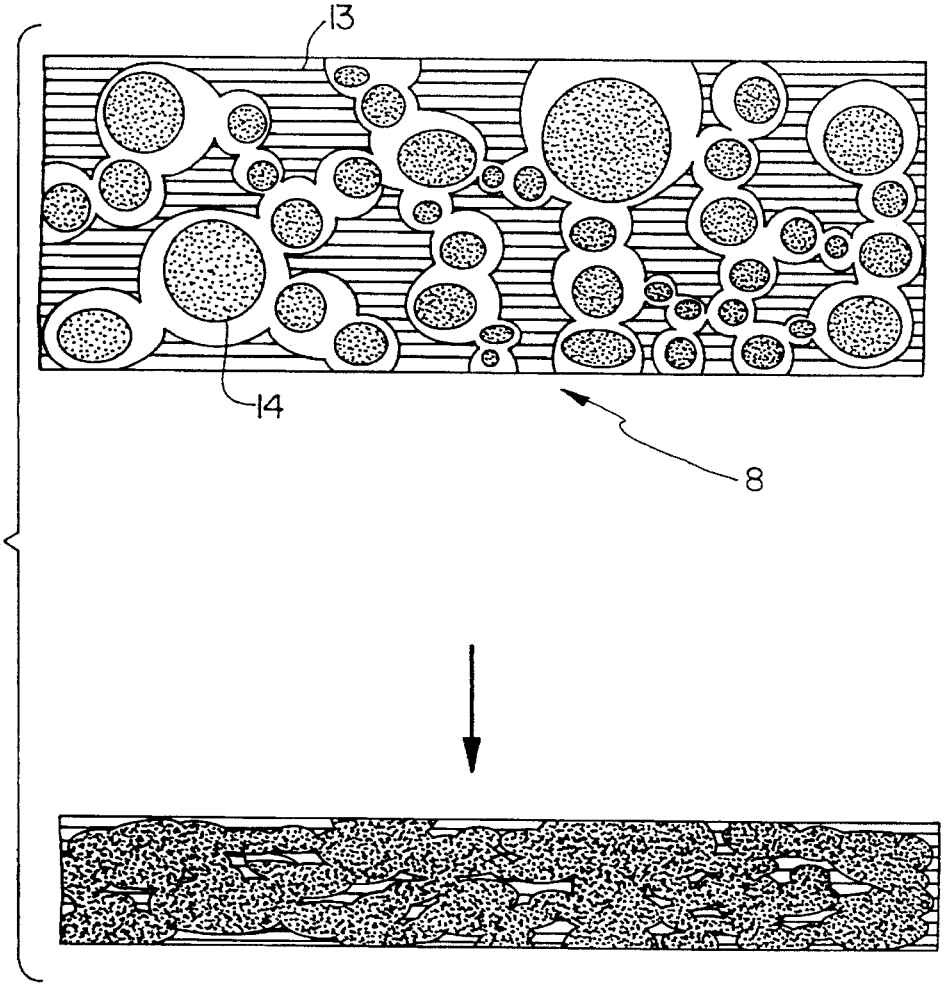
FIG. 6 is a view showing foam impregnated with bouncing putty.

In the embodiment, as can be seen in FIG. 6, the impact cushioning material 8 includes the open-cell foam 13 which is impregnated with the bouncing putty dissolved in a solvent that is volatilized after the impregnation. When a pressure is applied, the foam itself is compressed, whereby the bouncing putty particles 14 dispersed in the open-cell foam agglomerate due to its compression. Upon completion of the deformation of the impact cushioning material 8 under pressure, it will have the same behavior as that of the bouncing putty itself.

The impact cushioning material 8 is disposed on the side wall portion 6 of the body 2 extending from the area corresponding to the inner arch portion of the foot 3 to the area corresponding to the outer lateral side of the foot 4 through the area corresponding to the heel portion of the foot 7, covered with a fabric 9 such as a double russel fabric made of polyester and stitched to the body 2 to secure it thereto as indicated by reference number 10 in FIG. 2.

Not only the impact cushioning material 8 but also the flat portion 5 of the body 2 may be covered with the fabric 9.

In this preferred embodiment, woven fabrics are used. However, other materials having resistance to wear and high stretchability such as unwoven fabrics, leather, artificial leather or the like can also be used.

Figure 4:
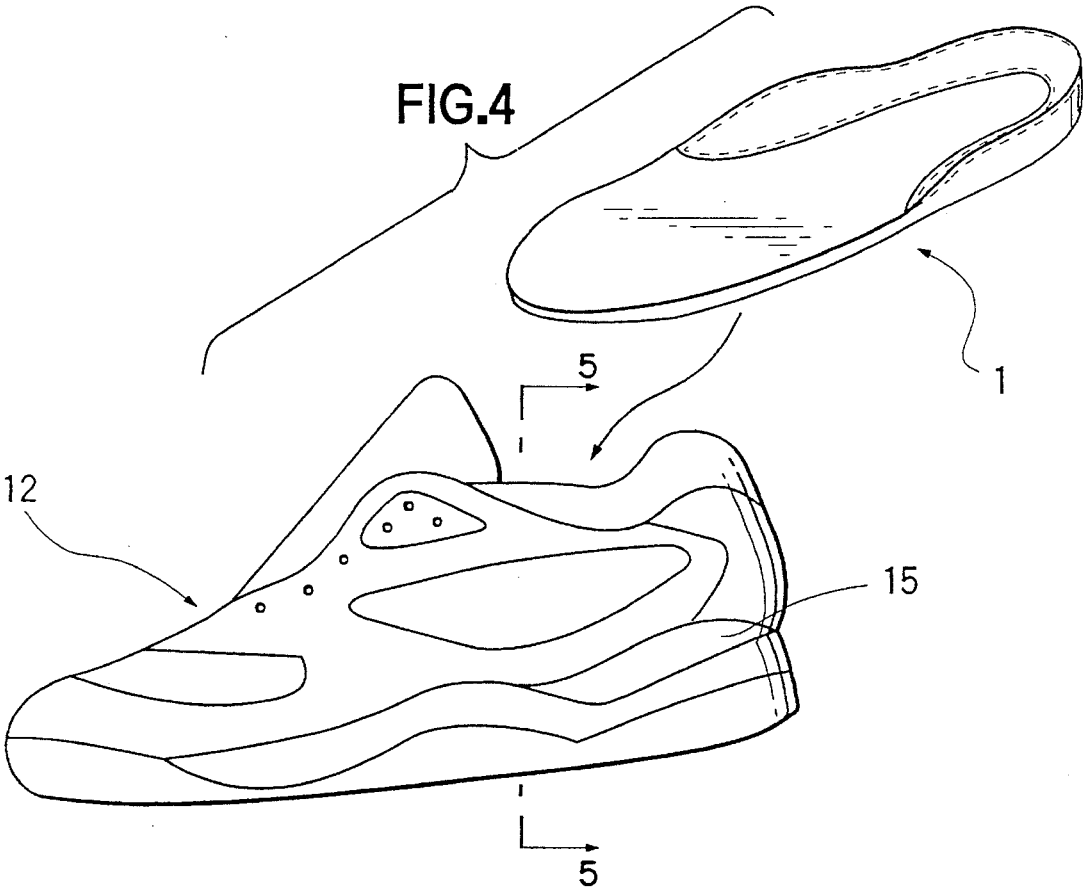
FIG. 4 is a view showing how to use a cup-like insole according to the invention.
Figure 5:
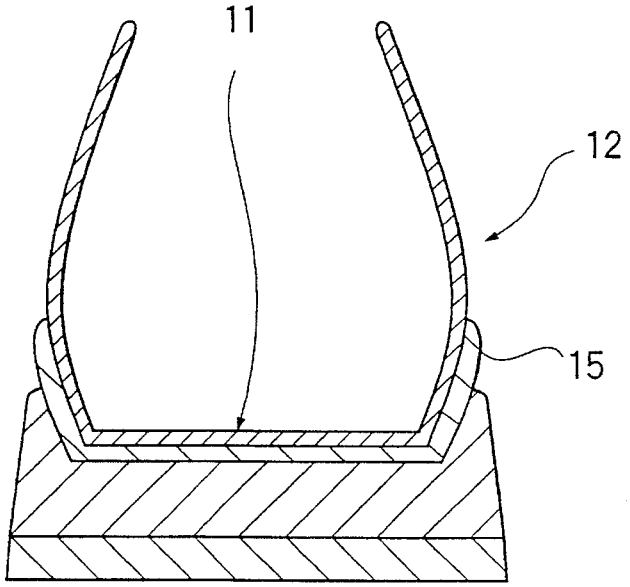
FIG. 5 is a cross-sectional view taken along line B—B of FIG. 4.

In use, the cup-like insole 1, constructed as described hereinabove, is disposed on a inner bottom surface 11 of a shoe 12 as shown in FIG. 4. Since the shoe 12 is provided with a cup-like stabilizer 15 having a higher hardness than that of a bottom member of the shoe 12 positioned at its heel area, the pressure applied by the heel of a wearer is transferred to the impact cushioning material 8 without escaping to the bottom member of the shoe which makes it possible to exhibit a higher effect of the bouncing putty.

Although in this preferred embodiment, the cup-like stabilizer 15 is used, a heel counter providing the same effect can be used.

Furthermore, in the case where the shoe is not provided with the cup-like stabilizer 15 or the heel counter, the same effect can be achieved by utilizing the cup-like insole 1 whose the side wall portion 6 of the body 2 is formed from a material having high hardness such as nylon, urethane, PVC, or the like.

The cup-like insole constructed as described hereinabove provides the following effects.

Since the cup-like insole is made of the elastic resin having a suitable rigidity, it allows the impact cushioning material 8 disposed on the side wall portion 6 extending from the area corresponding to the inner arch portion of the foot 3 to the area corresponding to the outer lateral side of the foot 4 through the area corresponding to the heel portion of the foot 7 to fully deform to comform to any shape of the heel. Furthermore, once plastically deformed, due to the property of the bouncing putty, the impact cushioning material 8 exhibits a high degree of bounce under suddenly applied stresses holding the shape of the heel of the foot, thereby stablizing the heel of the wearer.

Because the cup-like stabilizer 15 or the heel counter having high hardness is provided with the shoe 12, pressure from the heel of the wearer is not liable to escape through the bottom member of the shoe and is applied to the impact cushioning material 8, whereby the impact cushioning material 8 can be plastically deformed, thereby exhibiting its higher effect to fit to the heel of the wearer.

Furthermore, in case of a shoe without the cup-like stabilizer, the impact cushioning material 8 can be plastically and fully deformed by forming the side wall portion 6 of the body 2 of the cup-like insole 1 with a material having high hardness.

In addition, the impact cushioning material 8 made of the open-cell foam impregnated with the bouncing putty provides a self-supporting capability to the bouncing putty provided that no permanent set in fatigue occurs, and the use of it results in significant reduction in a weight of the impact cushioning material 8, and hence, of the shoe compared with the one with the bouncing putty contained in a bag-like sheet.

The present invention has thus been shown and described with reference to a specific embodiment. However, it should be noted that the present invention is in no way limited to the details of the described arrangements but changes and modifications may be made without departing from the scope of the appended claims.

What is claimed is:

1. An insole for installation within a shoe, said insole comprising:

a body of elastic material adapted to fit to a bottom member of a shoe, said body of elastic material defining a flat portion and an upstanding side wall portion formed integrally with said flat portion, said upstanding side wall portion defining an outer convex surface and an inner concave surface and extending from an area of said body of elastic material corresponding to an inner arch portion of a foot to an area of said body of elastic material corresponding to an outer lateral side of the foot through an area of said body of plastic material corresponding to a heel portion of the foot;

impact cushioning material having bouncing putty and disposed on the inner concave surface of the upstanding side wall portion; and a sheet made of a material, selected from the group consisting of woven fabrics, unwoven fabrics and leather, covering the impact cushioning material and retaining the impact cushioning material on said inner concave surface of the upstanding side wall portion.

2. An insole as recited in claim 1, wherein said impact cushioning material is an open-cell foam impregnated with the bouncing putty.

3. An insole for shoes as recited in claim 2, wherein the impact cushioning material extends substantially along a full length of the side wall portion.

4. An insole for shoes as recited in claim 1, wherein the impact cushioning material extends substantially along a full length of the side wall portion.

5. An insole for shoes to be disposed within a shoe, comprising:

a body of elastic material adapted to fit to a bottom member of a shoe and having a flat portion and a concave side wall portion formed integrally with the flat portion, the side wall having an upper surface and extending from an area corresponding to an inner arch portion of a foot to an area corresponding to an outer lateral side of the foot through an area corresponding to a heel portion of the foot;

at least one impact cushioning material having open-cell foam impregnated with bouncing putty, which is plastically deformed easily under a stress applied slowly and exhibits a high degree of bounce under a stress applied suddenly, disposed along the upper surface of the side wall; and a sheet made of a material, selected from the group consisting of woven fabrics, unwoven fabrics and leather, covering the impact cushioning material to retain it on the upper surface of the side wall.

* * * * *